United States Patent [19]

Zollinger

[11] Patent Number: 4,824,043

[45] Date of Patent: Apr. 25, 1989

[54] YARN TENSIONING DEVICE

[75] Inventor: Otto Zollinger, Spartanburg, S.C.

[73] Assignee: Otto Zollinger, Inc., Spartanburg, S.C.

[21] Appl. No.: 172,289

[22] Filed: Mar. 23, 1988

[51] Int. Cl.[4] ..... B65H 59/24

[52] U.S. Cl. ..... 242/149; 242/152.1

[58] Field of Search ..... 242/149, 151, 152, 152.1, 242/147 R, 129.8; 226/195

[56] References Cited

U.S. PATENT DOCUMENTS

| | | | |
|---|---|---|---|
| 1,826,354 | 10/1931 | Lenk | 242/149 |
| 3,352,510 | 11/1967 | Franzen | 242/149 |
| 4,030,684 | 6/1977 | Levin | 242/152.1 |
| 4,297,834 | 11/1981 | Franzen | 242/149 X |
| 4,470,559 | 9/1984 | McBride, Jr. | 242/152.1 |

FOREIGN PATENT DOCUMENTS

| | | | |
|---|---|---|---|
| 1008938 | 2/1952 | France | 242/149 |

*Primary Examiner*—Stanley N. Gilreath

*Attorney, Agent, or Firm*—Shefte, Pinckney & Sawyer

[57] ABSTRACT

A yarn tensioning device having a yarn tensioning element mounted on a seat within a housing through which the yarn travels. A cap is mounted in the outlet of the housing and has a smaller opening than the size of the tensioning elements to prevent replacement or addition of elements and is secured in the housing to prevent removal. The cap has a tapered inner surface and two sequential frustoconical outer surfaces forming a juncture therebetween. The annular peripheral surface of the cap is relieved. The tensioning element is elongated and shaped to preclude rotation during operation and particularly when yarn travel stops during operation of the associated equipment.

14 Claims, 4 Drawing Sheets

YARN TENSIONING DEVICE

BACKGROUND OF THE INVENTION

The present invention relates to a yarn tensioning device and more particularly to a yarn tensioning device of the type having a housing with a yarn inlet and a yarn outlet for travel of yarn through the housing wherein the housing has an annular seat formed in the yarn inlet and a yarn tensioning element in engagable on the seat for applying tension to a yarn traveling between the seat and the tensioning element.

Yarn tensioning devices of this type, such as disclosed and claimed in my prior U.S. Pat. Nos. Re. 30,920, 31,024 and 31,041 have proven to be highly successful in providing reliable uniform tensioning of yarn in various types of yarn and thread processing equipment, such as in textile winders, warpers, weaving looms, knitting machines and the like and in other types of equipment in textile and other fields that involve processing or handling of traveling strand material. Previous devices of this general type have been provided with removable caps or retaining elements that allow removal and replacement of the tensioning elements, which has been considered advantageous in allowing the change of elements for operation with yarns of different size or running charactristics. However, this has led to improper substitution and addition of elements with resulting non-uniform and/or imperfect tensioning. According to one feature of the present invention this problem is overcome by using a cap that is fixed against removal and has a yarn passageway therein smaller than the size of the tensioning element so that once the device is assembled with the tensioning element in the housing and the cap fixed thereon the tensioning element cannot be replaced and additional tensioning elements cannot be inserted. In this regard, it has been determined that a selected size of tensioning element is normally suitable for use with a wide range of yarn types and characteristics and with a wide range of types of equipment, such that changing of tensioning elements or removing or adding elements is not necessary and when such changes are made it can result in problems when not done with expertise in selection of the elements to be used.

When using a cap on the housing of a tensioning device of this type, it is sometimes difficult to initially thread the yarn through the housing and cap as a threading rod may be obstructed by the inner surface of the cap and threading by air can also be disrupted by the shape of the inner surface of the cap. This is particularly a problem where the cap is formed with a small passageway for the purpose mentioned above of preventing removal or insertion of tensioning elements. To alleviate this problem, the present invention forms the cap with a frusto-conical inner annular surface tapering from the housing to the passageway so that a threading rod will be guided along this surface into the passageway and an air threading blast will also be directed toward the passageway.

The aforementioned frusto-conical inner annular surface of the cap further can provide enhanced yarn behavior in certain yarns as the yarns pass through the device and contact this inner annular surface. Enhanced behavior of some yarns is also obtained by another feature of the present invention wherein the outer annular surface of the cap is formed with two sequentially adjacent frusto-conical surface portions of progressively greater taper forming a yarn contacting annular juncture therebetween. Thus, as the yarn passes over this surface and contacts this juncture improved behavior of the yarn is obtained, particularly with high torque yarn where this action results in a relaxation of the yarn.

Improved handling of yarn is further facilitated by another feature of the present invention wherein the cap is formed with a relieved peripheral outer annular surface that eliminates yarn contact with an otherwise sharp outer edge of the cap.

In the prior tensioning devices of this general type, the tensioning elements are commonly in the form of spherical elements or balls that are free to rotate under the influence of the yarn as the yarn travels through the device, thereby reducing friction and providing a smooth tensioning application. However, in some applications a free rolling ball is a disadvantage, particularly when the yarn stops traveling and the ball rolls down onto the seat against the yarn, with the rolling of the ball disrupting yarn so as to create picks and at times causing the yarn to wind on the ball. This is particularly noticeable with quick stopping of high speed operations, such as in shuttleless loom weaving and high speed warping. To overcome this problem, a further feature of the present invention provides for a tensioning element that is sufficiently non-spherical to preclude substantial rotation of the element during travel of the yarn therepast.

SUMMARY OF THE INVENTION

Briefly described, the yarn tensioning device of the present invention includes a housing having a yarn inlet and a yarn outlet for travel of yarn through the housing, with the housing having an annular seat formed in the yarn inlet on which a yarn tensioning element is engagable for applying tension to a yarn traveling between the seat and the tensioning element. The device of the present invention incorporates one or more of the following features either separately or in combination.

According to one feature, a cap is fixed against removal in the yarn outlet and has a yarn passageway therethrough smaller than the tensioning element to prevent removal or replacement of the tensioning element. Preferably, the housing has an annular recess at the outlet for receipt of the cap and the cap has an annular shoulder insertable in the housing recess and inclined outwardly into the recess for substantially non-removable seating of the cap in the housing. In the preferred embodiment, the shoulder of the cap is inclined outwardly at an angle of approximately 4 degrees.

According to another feature of the present invention, the cap is formed with a frusto-conical inner annular surface tapering from the housing to the passageway. In the preferred embodiment, the frusto-conical inner surface tapers at an angle of approximately 30 degrees.

According to another feature of the present invention, the cap has an outer annular surface extending from the passageway and formed with two sequentially adjacent frusto-conical surface portions of progressively greater taper forming a yarn contacting annular juncture therebetween. In the preferred embodiment the tapers of the surface portions are approximately 30 degrees and 60 degrees.

According to a further feature of the present invention, the cap is formed with a relieved peripheral outer annular surface that is preferably relieved at approximately 30 degrees.

According to an addition feature of the present invention, the tensioning element is sufficiently non-spherical to preclude substantial rotation of the element during travel of the yarn therepast. Preferably this is accomplished by forming the yarn tensioning element elongated in a direction away from the seat and having a partially spherical surface portion on the element engagable on the annular seat. In one form, the tensioning element is in the form of two spherical elements secured together, and in another form the element has semi-spherical ends and a cylindrical center portion therebetween.

DETAILED DESCRIPTION OF THE PREFERRED EMBODIMENTS

Figure 1:
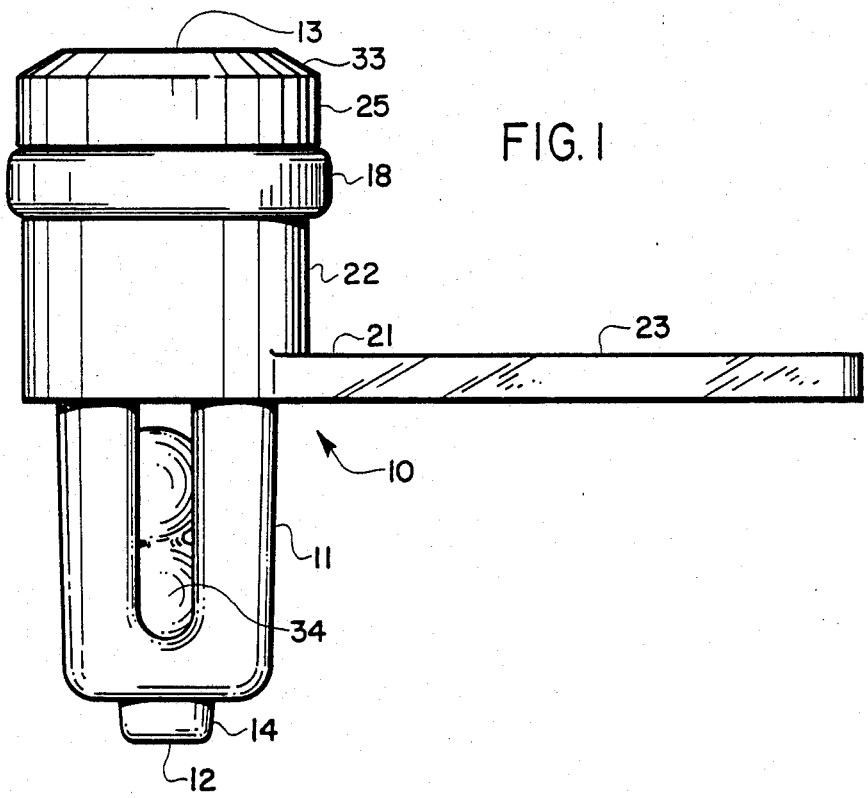
FIG. 1 is a side elevation of a yarn tensioning device according to the preferred embodiment of the present invention.
Figure 2:
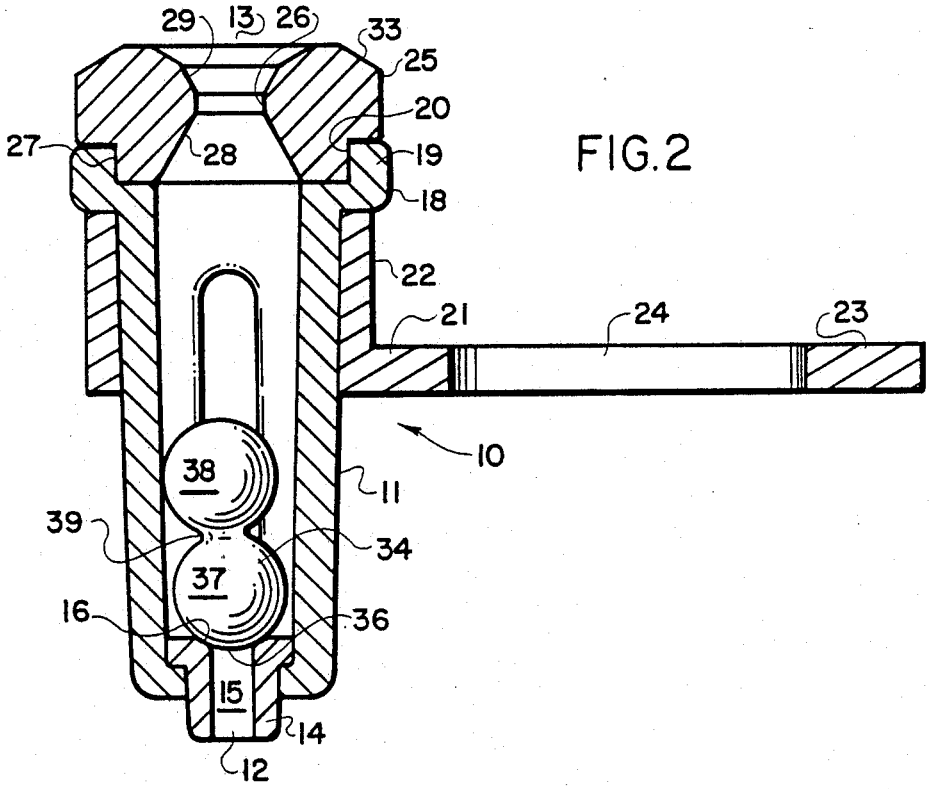
FIG. 2 is a vertical sectional view of the yarn tensioning device of FIG. 1.
Figure 3:
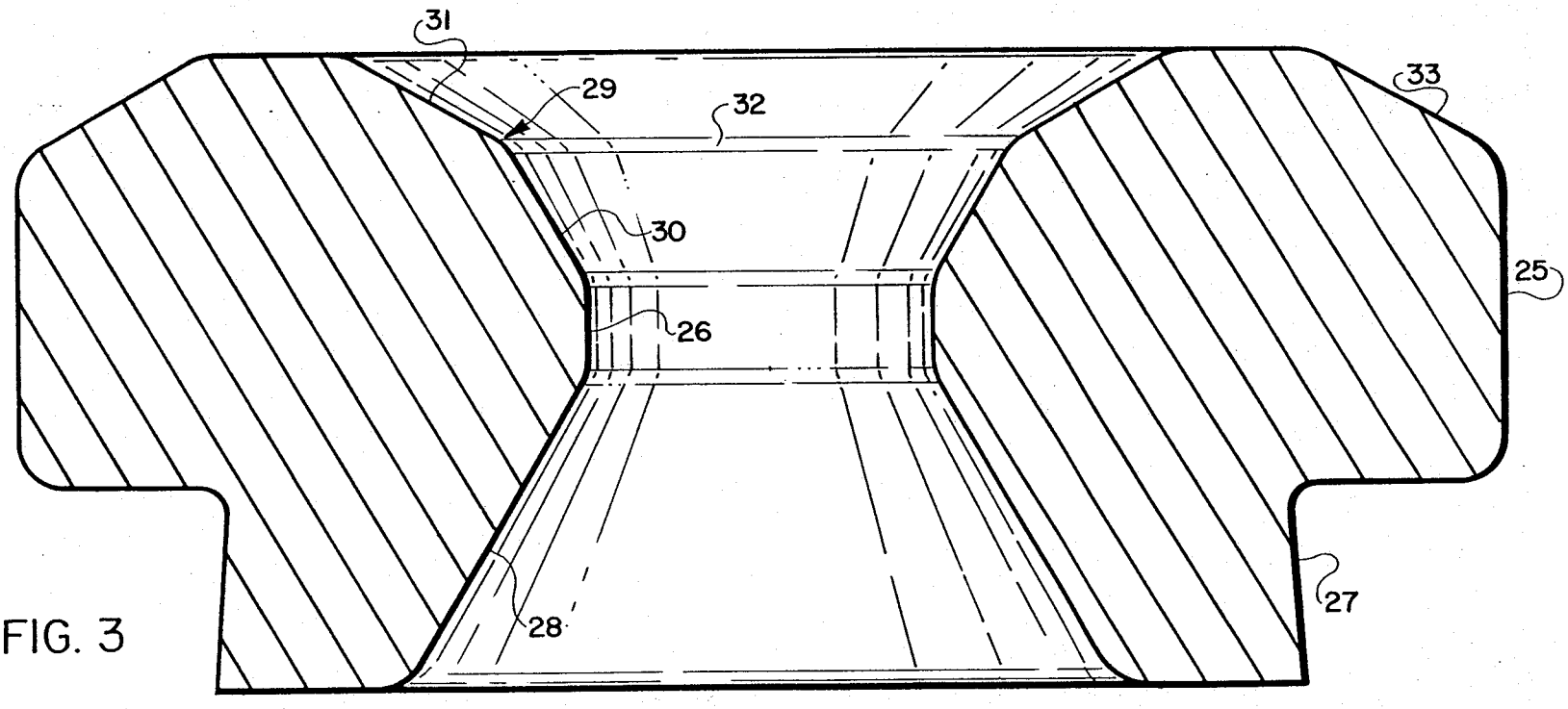
FIG. 3 is an enlarged vertical sectional view of the cap of the yarn tensioning device of FIG. 1.

Referring first to FIGS. 1, 2 and 3, a yarn tensioning device 10 according to a preferred embodiment of the present invention is shown having a generally cylindrical housing 11 formed with a yarn inlet 12 and a yarn outlet 13. Mounted in the inlet 12 is an insert 14 having a central yarn passage 15 extending therethrough and a seat 16 formed at the inner end of the yarn passage 15 within the housing 11. A yarn tensioning element 17 (FIG. 4) is contained within the housing 11 and engages on the seat 16 of the insert 14 for applying tensioning weight to a yarn traveling through the housing 11 and between the insert seat 16 and tensioning element 17.

The housing 11 is formed with an enlarged end 18 at the outlet 13. This enlarged end 18 forms an annular flange 19 defining an annular recess 20 therewithin.

The device 10 is mounted on a convenient structure in relation to the equipment with which the device is being used by the use of a mounting bracket 21 having a cylindrical portion 22 surrounding the housing 11 and abutting the enlarged end 18. The mounting bracket 21 has a flat plate-like projection 23 extending from the cylindrical portion 22 and having a slot 24 formed therein through which a mounting element can be inserted for mounting of the bracket 21 and attached tensioning device 10 to the desired supporting structure.

Mounted in the yarn outlet 13 of the housing 11 is a cap 25 that is fixed against removal from the housing 11 and has a generally cylindrical yarn passageway therethrough, which is smaller than the tensioning element 17 to prevent removal or replacement of the tensioning element. The cap 25 has an annular shoulder that is inserted in the aforementioned housing recess 20, with the shoulder 27 being inclined outwardly into the recess 20 for substantially non-removable seating therein. The outward inclination of the shoulder 27 is preferably at an angle of approximately 4 degrees. With this arrangement, particularly when the components are made of plastic material, and dimensioned for tight fit, once the shoulder 27 of the cap 25 is inserted in the housing recess 20, it is substantially impossible to remove the cap, thus assuring that the tensioning element 17 initially selected for proper operation cannot be changed thereafter. Therefore, an inexperienced or inattentive operator cannot change the size or form of tensioning element or add additional elements, which could change the performance of the device. In this regard, it has been discovered that a selected size or shape of tensioning element is capable of substantially optimum tensioning application over a relatively wide range of yarn sizes and characteristics and in a variety of equipment.

As illustrated in FIGS. 1–4, and as best seen in the enlargement of FIG. 3, the cap 25 is formed with a frusto-conical inner annular surface 28 tapering from the housing 11 to the cylindrical yarn passageway 26. Preferably, the frusto-conical inner surface 28 tapes at an angle of approximately 30 degrees to a vertical center line through the device. This conical configuraiton and the relatively small taper facilitates the initial threading of yarn through the device when using a threading rod which will be easily deflected along the conical surface 28 into and through the yarn passageway 26. Also, the gentle taper also facilitates the direction of air to and through the yarn passageway 26 when threading with an air device. In addition, the conical shape can provide improved yarn behavior during tensioning. For example, when running high torque yarn this surface can provide a relaxing of the twist. This is a particular advantage during warping of open-end yarn and during intermittent non-uniform motion that is characteristic of weaving. This frustoconical shape does not provide an advantage in all applications, but it does provide a significant advantage in selected applications, and it has not been found to be disadvantageous in any application.

As further illustrated in FIGS. 1–4, and particularly in the enlargement of FIG. 3, the cap 25 has an outer annular surface 29 extending from the yarn passageway 26. This outer surface is formed with two sequentially adjacent frustoconical surface portions 30 and 31 of progressively greater taper forming a yarn contacting annular juncture 32 therebetween. Preferably the taper of the inner portion 30 is approximately 30 degrees from the general center line of the device and the taper of the outer portion 31 is approximately 60 degrees from the general center line of the device. This double taper with a distinct annular juncture therebetween has been found to be advantageous in reducing friction of the yarn running over the surface of the cap, particularly in comparison with a generally round surface, which, with some types of yarn causes undesirable spreading. By eliminating the rolling or rotating of the tensioning element, the tensioning element will drop quickly against the seat stopping the yarn travel quicker than when a spherical element rolls onto the seat. For example, fiberglass and open (non-twisted) filament yarn tend to spread on a curved surface of a tensioning device whereas with the double angled and junctured surfaces of the present invention, friction is reduced and spreading is minimized.

Figure 4:
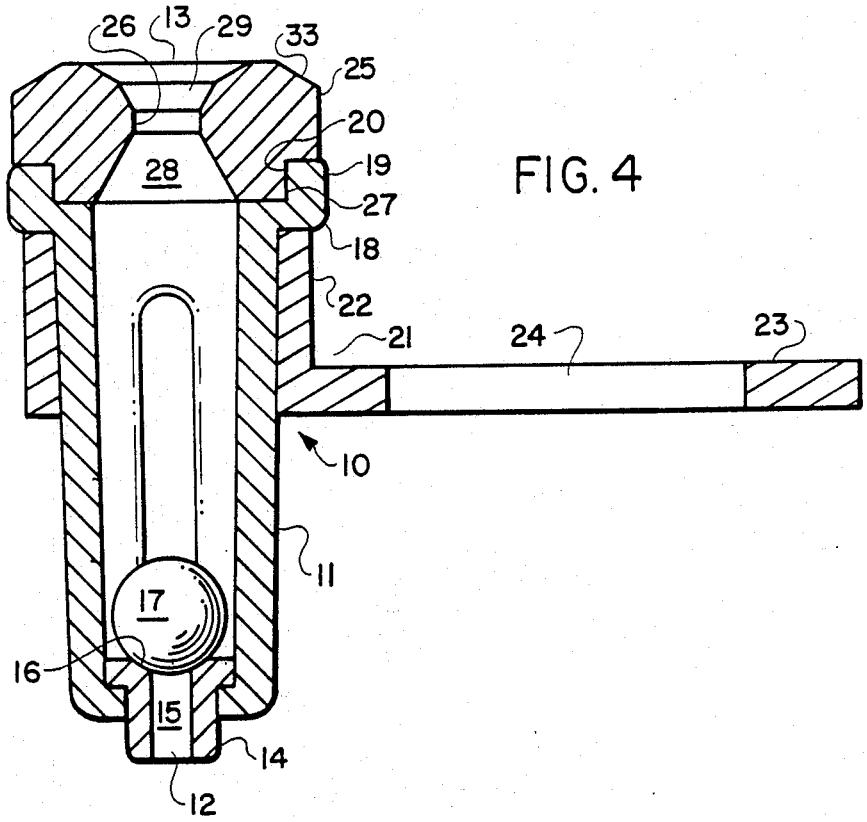
FIG. 4 is a view similar to FIG. 2 showing a different type of tensioning element in the yarn tensioning device.

To further facilitate uniform, smooth handling of yarn traveling through the device 10, the cap 25 is formed with a relieved peripheral outer annular surface 33, which is preferably relieved at an angle of approximately 30 degrees. This avoids undesirable sharp contact with a yarn that is guided in a direction that results in some contact with the outer peripheral edge of the cap 25. As illustrated in FIG. 4, the above-described cap 25 can be used in a device 10 that contains a conventional spherical tensioning element 17. However, enhanced results have been obtained with some types of yarn and with some types of equipment by using, according to the present invention, a tensioning element 34 (FIGS. 1, 2 and 5) or 35 (FIG. 6), that is sufficiently non-spherical to preclude substantial rotation of the element during traveling of the yarn therepast. In some applications with some types of yarn, a free-rolling spherical element has the disadvantage of creating yarn picks and winding of the yarn on the element when the yarn travel is stopped during the intermittent action of the equipment. This is particularly a problem in quick stopping of high speed operations, such as with shuttleless loom weaving or high speed warping. Open filament yarn and fine filament yarns are particularly susceptible to this problem. In some applications, this is not a problem, such as in most winding operations, but as indicated there are selected applications where this feature is advantageous. Preferably, the yarn tensioning elements 34,35 are elongated in a direction away from the seat 16 so as to be maintained in position in the housing 11, and they have partially spherical surface portions 36 that are enagable on the seat 16 for uniform yarn engagement around the circumference of the seat 16.

Figure 5:
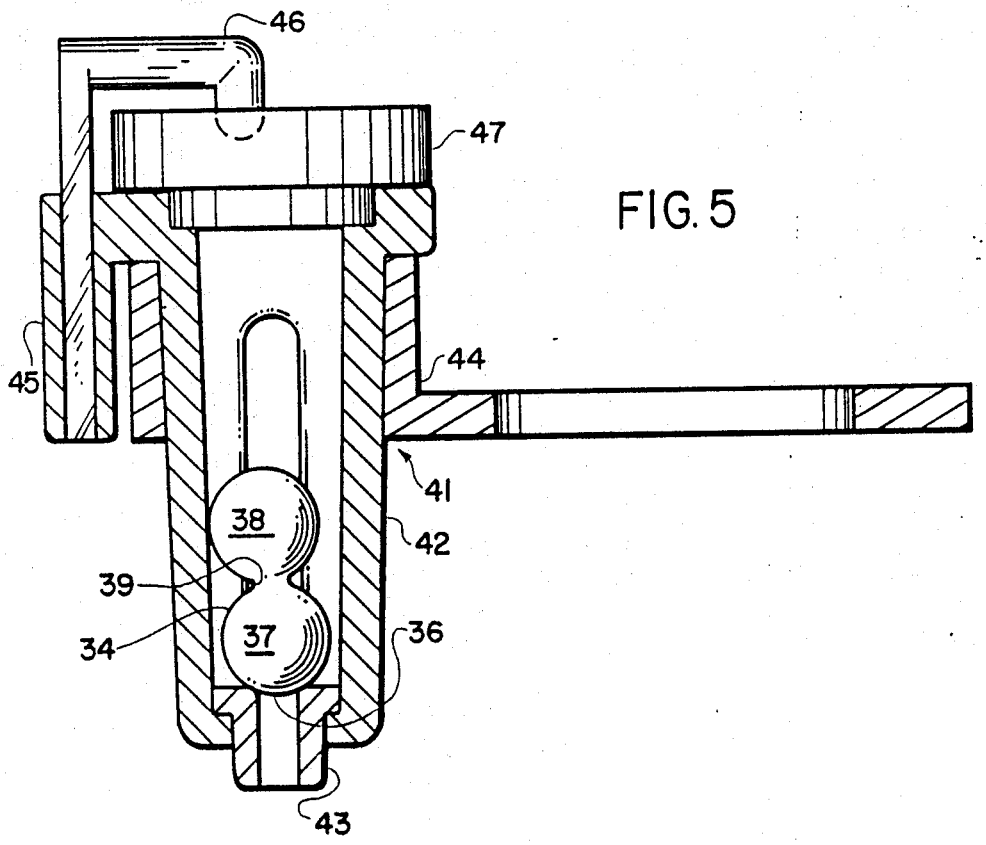
FIG. 5 is a view similar to FIG. 2 showing a conventional cap and retaining element.

In the form of the tensioning element 34 illustrated in FIGS. 1, 2 and 5, the tensioning element 34 is in the form of two spherical elements 37 and 38 secured together as at 39 by welding or other securing means. In this form, the tensioning element 34 can easily be manufactured from existing spherical elements and can be a combination of different size individual elements, such as using a larger element on top, which can be an advantage in some applications where additional weight is desired. In this manner the bottom spherical component can shift on the seat while the top component remains somewhat stationary and applies uniform weight. Also, a small spherical component at the bottom permits deeper seating with greater friction than is the case with a larger component at the bottom.

Figure 6:
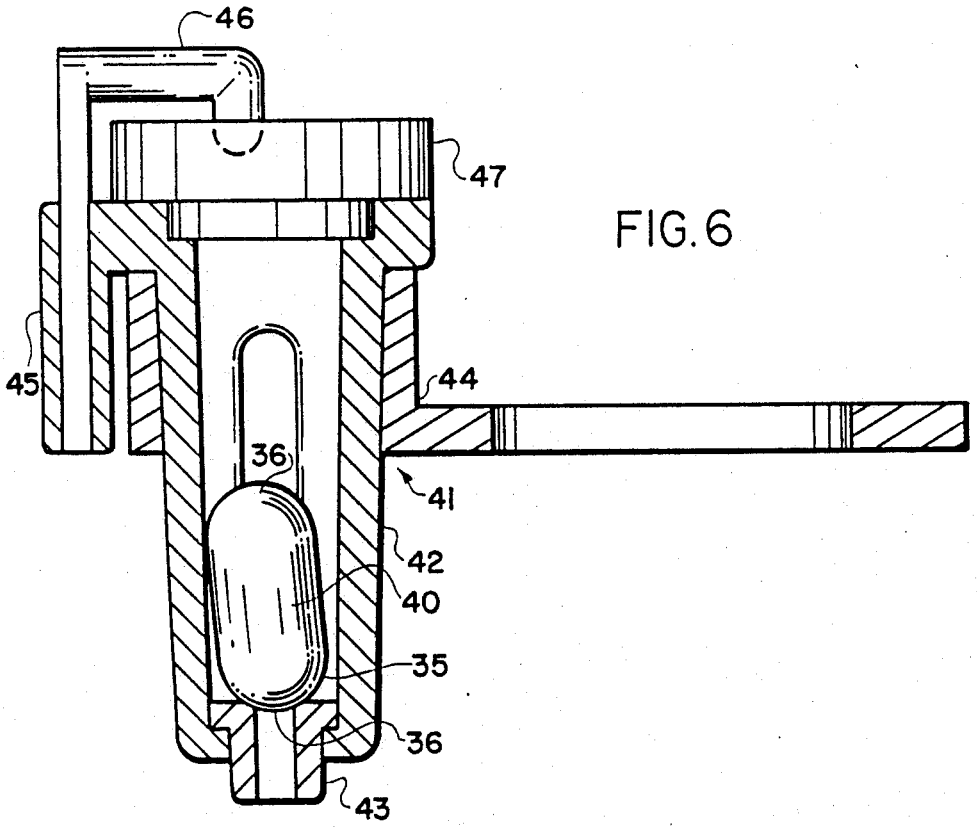
FIG. 6 is a view similar to FIG. 5 showing a different type of yarn tensioning element within the device.

An alternate form of yarn tensioning element 35 is illustrated in FIG. 6, where the element is seen to have semi-spherical portions 36 at both ends and a cylindrical center portion 40 therebetween. In this form the tensioning element 35 would be specially formed rather than combined from existing spherical components, but having semi-spherical end portions 36 allows the tensioning element 35 to be inserted with either end at the seat 16.

It is apparent that the foregoing individual features of the present invention are preferably used in combination, but they may also be used individually or in subcombinations to advantage in particular applications, as will be recognized by one skilled in the art.

As illustrated in FIGS. 5 and 6, the tensioning element of the present invention in the forms of the secured spherical elements 37,38 and in the form of the element 35 with the cylindrical center portion 40, may be incorporated in an otherwise conventional yarn tensioning device 41 having similar housing 42, insert 43 and mounting bracket 44 elements as described with regard to the embodiments of FIGS. 1–4, but with the housing 42 being conventionally constructed with a side projection 45 in which a tensioning element retaining finger 46 is positioned for pivoting into and out of position above the housing 42 to retain the tensioning element 35 within the housing 42 during operation and movable out of position to allow removal or replacement of the tensioning element 35. Also, in the form of FIGS. 5 and 6, a conventional cap 47 is used without the features described above for the cap 25 of the embodiments of FIGS. 1–4.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiment, adaptations, variations, modifications and equivalent arrangements, the present invention being limited only by the claims appended hereto and the equivalents thereof.

I claim:

1. A yarn tensioning device comprising a housing having a yarn inlet and a yarn outlet for travel of yarn through said housing, said housing having an annular seat formed in said yarn inlet, a yarn tensioning element in said housing engagable on said seat for applying tension to a yarn traveling between said seat and said tensioning element, and a cap fixed against removal in said yarn outlet and having a yarn passageway therethrough smaller than said tensioning element to prevent removal or replacement of said tensioning element, said cap being formed with a frusto-conical inner annular surface tapering from said housing to said passageway.

2. A yarn tensioning device according to claim 1 and characterized further in that said frusto-conical inner surface tapers at an angle of approximately 30°.

3. A yarn tensioning device comprising a housing having a yarn inlet and a yarn outlet for travel of yarn through said housing, said housing having an annular seat formed in said yarn inlet, a yarn tensioning element in said housing engagable on said seat for applying tension to a yarn traveling between said seat and said tensioning element, and a cap fixed against removal in said yarn outlet and having a yarn passageway therethrough smaller than said tensioning element to prevent removal or replacement of said tensioning element, said cap having an outer annular surface extending from said passageway, said outer surface being formed with two sequentially adjacent frusto-conical surface portions of progressively greater taper forming a yarn contacting annular juncture therebetween.

4. A yarn tensioning device according to claim 3 and characterized further in that the tapers of said surface portions being approximately 30° and 60°.

5. A yarn tensioning device comprising a housing having a yarn inlet and a yarn outlet for travel of yarn through said housing, said housing having an annular seat formed in said yarn inlet, a yarn tensioning element in said housing engagable on said seat for applying tension to a yarn traveling between said seat and said tensioning element, and a cap mounted in said yarn outlet and having a yarn passageway therethrough, said cap being formed with a frusto-conical inner annular surface tapering from said housing to said passageway.

6. A yarn tensioning device according to claim 5 and characterized further in that said frusto-conical inner surface tapers at an angle of approximately 30°.

7. A yarn tensioning device according to claim 5 and characterized further in that said cap has an outer annular surface extending from said passageway, said outer surface being formed with two sequentially adjacent frusto-conical surface portions of progressively greater taper forming a yarn contacting annular juncture therebetween.

8. A yarn tensioning device according to claim 7 and characterized further in that the tapers of said surface portions being approximately 30° and 60°.

9. A yarn tensioning device according to claim 7 and characterized further in that said cap is formed with a relieved peripheral outer annular surface.

10. A yarn tensioning device according to claim 9 and characterized further in that the relief of said peripheral surface is approximately 30°.

11. A yarn tensioning device comprising a housing having a yarn inlet and a yarn outlet for travel of yarn through said housing, said housing having an annular seat formed in said yarn inlet, a yarn tensioning element in said housing engagable on said seat for applying tension to a yarn traveling between said seat and said tensioning element, a cap mounted on said housing at said yarn outlet and having a yarn passageway therethrough, said cap having an outer annular surface extending from said passageway, said outer surface being formed with two sequentially adjacent frusto-conical surface portions of progressively greater taper forming a yarn contacting annular juncture therebetween.

12. A yarn tensioning device according to claim 11 and characterized further in that the tapers of said surface portions being approximately 30° and 60°.

13. A yarn tensioning device according to claim 11 and characterized further in that said cap is formed with a relieved peripheral outer annular surface.

14. A yarn tensioning device according to claim 13 and characterized further in that the relief of said peripheral surface is approximately 30°.

* * * * *